US009568283B2

(12) United States Patent
Brill et al.

(10) Patent No.: US 9,568,283 B2
(45) Date of Patent: Feb. 14, 2017

(54) ENCLOSURE PROTECTING SYSTEM AND METHOD

(75) Inventors: Alon Brill, Haifa (IL); Boaz Cohen, Gush Segev (IL); Ron Genussov, Haifa (IL)

(73) Assignee: Rafael Advanced Defense Systems LTD, Haifa (IL)

( * ) Notice: Subject to any disclaimer, the term of this patent is extended or adjusted under 35 U.S.C. 154(b) by 0 days.

(21) Appl. No.: 13/063,855

(22) PCT Filed: Jul. 15, 2009

(86) PCT No.: PCT/IL2009/000702

§ 371 (c)(1),
(2), (4) Date: Mar. 14, 2011

(87) PCT Pub. No.: WO2010/029530

PCT Pub. Date: Mar. 18, 2010

(65) Prior Publication Data

US 2011/0162518 A1 Jul. 7, 2011

(30) Foreign Application Priority Data

Sep. 15, 2008 (IL) ..... 194090

(51) Int. Cl.
*F41H 11/00* (2006.01)
*F41H 5/007* (2006.01)

(52) U.S. Cl.
CPC ..... *F41H 5/007* (2013.01)

(58) Field of Classification Search
CPC ..... F41H 5/007
USPC ..... 89/36.17, 902
See application file for complete search history.

(56) References Cited

U.S. PATENT DOCUMENTS

| | | | | |
|---|---|---|---|---|
| 3,875,844 | A * | 4/1975 | Hicks | 89/1.11 |
| 3,893,368 | A * | 7/1975 | Wales, Jr. | 89/36.17 |
| 6,327,955 | B1 * | 12/2001 | Kerdraon et al. | 89/36.17 |
| 6,681,679 | B2 * | 1/2004 | Vives et al. | 89/36.17 |
| 7,104,178 | B1 | 9/2006 | Zank | |
| 7,286,213 | B2 * | 10/2007 | Bredy | 356/141.1 |
| 7,827,900 | B2 * | 11/2010 | Beach et al. | 89/36.17 |

(Continued)

FOREIGN PATENT DOCUMENTS

| | | |
|---|---|---|
| DE | 42 26 897 C1 | 1/1998 |
| EP | 0 922 924 A1 | 6/1999 |

(Continued)

OTHER PUBLICATIONS

Notification of Transmittal of the International Search Report and the Written Opinion of the International Searching Authority, or the Declaration, International Application No. PCT/IL2009/000702, mailed on Oct. 28, 2009.

*Primary Examiner* — Gabriel Klein
(74) *Attorney, Agent, or Firm* — Vorys, Sater, Seymour & Pease LLP

(57) ABSTRACT

Provided is an RPG disruption system (RDS) for protecting an enclosure against RPG's, the system including a casing fixed in close proximity to a wall of the enclosure facing an anticipated RPG threat. The casing includes an anvil accommodating a propelling mechanism for propelling the disrupting element, and an activating system for activating the propelling mechanism so as to propel the disrupting element towards an approaching RPG, to thereby neutralize it.

26 Claims, 6 Drawing Sheets

(56) References Cited

U.S. PATENT DOCUMENTS

2011/0120294 A1* 5/2011 Beach et al. ..... 89/36.02

FOREIGN PATENT DOCUMENTS

| | | | |
|---|---|---|---|
| FR | 2 799 829 | A1 | 4/2001 |
| FR | 2 863 055 | A1 | 6/2005 |
| FR | 2 909 441 | A1 | 6/2008 |
| GB | 2 329 233 | A | 3/1999 |
| IL | 109223 | A | 8/2006 |
| WO | 2006/134407 | A1 | 12/2006 |
| WO | 2007/089253 | A2 | 8/2007 |

* cited by examiner

ENCLOSURE PROTECTING SYSTEM AND METHOD

This is a National Phase Application filed under 35 U.S.C. §371 as a national stage of PCT/IL2009/000702, filed on Jul. 15, 2009, an application claiming the benefit under 35 U.S.C. §119 of Israeli Patent Application No. 194090, filed on Sep. 15, 2008, the content of each of which is hereby incorporated by reference in its entirety.

FIELD OF THE INVENTION

This invention relates to a system and method for protecting an enclosure against attack of projectiles and in particular, but not restricted, against the attack of Rocket Propelled Grenades (RPGs).

The term 'enclosure' as used herein the specification and claims denotes any form of vehicle such as land vehicles (e.g. soft vehicles, trucks, Armoured Personnel Carriers (APCs), Armoured Fighting Vehicles (AFVs), self propelled guns, etc.), maritime vessels and helicopters and different forms of structures, e.g. buildings, bunkers, warehouse, etc.

The term RPG is used herein in its broad definition and refers to a variety of rockets fitted with a shaped (hollow) charge shaped so as to focus the effect of the explosive energy and fitted with a sensor.

BACKGROUND OF THE INVENTION

When discussing protection of combat vehicles e.g. troop carriers, tanks and the like, one may consider using a variety of different passive or reactive armors, the latter typically comprising protective modules comprising in turn one or more plates with explosive material embedded there between, to be ignited upon impact of a projectile, resulting in imparting the one or more plates to propel in a direction so as to disrupt the kinetic energy and that of a hollow charge of the threat.

It is also known to increase effectiveness of protection systems by utilizing a threat detecting system for instant activating protective modules facing the upcoming threat.

U.S. Pat. No. 6,681,679 discloses an active protection device for a wall against attack by a projectile and comprising: at least one explosive charge able to project at least one metallic block in the direction of the projectile, wherein each block of the at least one block is in the shape of an elongated bar which has a maximal length greater than or equal to 10 times a smallest crosswise dimension, the explosive charge being positioned opposite a longitudinal surface of the bar; and a support having a bottom plate intended to be fastened to the wall and onto which the explosive charge is placed, wherein the support incorporates a longitudinal cavity delimited by two lateral checks and accommodating the explosive charge and the at least one bar.

One type of threat often used against light vehicles is the widely used RPG, in its various forms, which is up to date considered as one of the most successful antitank grenade ever manufactured. An RPG is usually fitted with a shaped charge comprising a cylinder of explosive with a metal-lined conical hollow, an inverted metal-liner cone which together constitute a 'hollow space, a detonator in conjunction with the explosive, said detonator being electrically coupled to a Piezo-electric sensor at a fore end of the missile via a conductive aerodynamic cover and said liners. In some cases there are provided electric wires instead of conductive liners.

The arrangement is such that upon impact of the Piezo-electric crystal sensor with a target, an electric current generates and is conducted via the conductive aerodynamic cover and said liners to ignite the detonator resulting in detonation of the explosive which drives the conical liner to collapse upon its central axis. The resulting collision forms and projects a high-velocity jet of metal and gases (plasma) which is deadly and devastating.

Various solution have been proposed for protecting tanks, APCs and structures, ranging from reactive armor systems, through metal slat-armor in the form of a metallic cage mounted on the enclosure to be protected, ending with sand bags placed there over.

SUMMARY OF THE INVENTION

The present invention is concerned with a system and a method for neutralizing Rocket Propelled Grenades (RPGs), i.e. preventing initiation of the explosive material of the RPG before it strikes against an enclosure to be protected.

Disrupting, according to the present invention is in the sense of preventing electric initiation of the charge of the upcoming threat by shortcutting or detaching electric wiring associated therewith.

According to the present invention there is provided an RPG Disruption System (RDS) for protecting an enclosure against RPG's, the system comprising a casing fixed in close proximity to a wall of the enclosure facing an anticipated RPG threat, said casing comprising an anvil accommodating a propelling mechanism for propelling said disrupting element; and an activating system for activating said propelling mechanism so as to propel the disrupting element towards an approaching RPG, to thereby neutralize it.

According to the present invention the RPG is neutralized by preventing the detonator from activating the explosive. This is obtained by disrupting/preventing the electric initializing of the explosive either by breaking or truncating the Piezo-electric sensor from the RPG or by causing an electric shortcut by deforming the conductive wires or aerodynamic cover and inner part.

The system and a module according to the present invention may further comprise any one or more of the following features:

- The disrupting element is propelled in a plane substantially parallel to said wall. However, according to a modification of the invention, the disrupting element may be propelled non-parallel to the wall, depending on the type of mounting.
- A sensor is provided for early detection of a launched RPG, for initiating one or more systems according to the present invention, facing an approaching RPG. The sensor may be a thermal detector, flare detector, blast detector, image detector, etc., whereby upon detection of an approaching RPG the system is armed and is ready to handle the threat. Otherwise, the RPG Disruption System (RDS) may be manually initiated (e.g. by a commander of a vehicle) or it may normally set to an initiated, active state.
- The propelling mechanism is designed for propelling the disrupting element by applying a bursting force of great magnitude between the anvil and the disrupting element, e.g. an explosive charge generating thrust, a magnetic force, or different forms of springs such as a preloaded mechanical spring, discharge of compressed gas, etc.
- A detection system is provided, defining an imaginary plane covered by the disrupting element, generating an activating signal to instantaneously propel the disrupting element. Such a detection system can be an optic sensor, magnetic sensor, acoustic sensor and the like.

The detection mechanism may be in the form of a mechanical barrier defining an imaginary plane, e.g. a fine mesh, web or grid, whereupon tensioning, pressure or piercing same generates the activating signal. Such a detection mechanism may be a sheet emitting an electric pulse upon change in tension or tear thereof.

A controller/microprocessor is provided for generating a control signal to activate the propelling mechanism at a calculated timing such that the propelled disrupting element is likely to engage the approaching RPG and neutralize it. The controller/microprocessor receives an activating signal from the detection mechanism and in turn generates said control signal to recite the propelling mechanism.

The disrupting element is made of a rigid and hard material such as different metals or alloys, or suitable composite materials. The disrupting element is an elongate bar which may assume different cross-section shapes, e.g. blade-like (i.e. an edge thereof facing the center of the wall of the enclosure is narrower than the body thereof), a rectangle bar, cross-like, triangle-like, etc.

The RPG Disruption System (RDS) is suited for securing to the wall of the enclosure at different fashions. For example, it may extend from an edge of the wall with the disrupting element facing towards a center of the wall, or the RDS may be fixed at a central portion of the wall such that the disrupting element faces outwards (facing a respective edge of the wall).

The RPG Disruption System (RDS) is in the form of a module/cassette suited for modular attaching to the enclosure.

The disrupting element is propelled substantially parallel to the anvil. However, according to an option of the invention, the disrupting element is displaced non-parallel with respect to the anvil, e.g. by applying different amounts of explosive material or materials having different explosive properties. Likewise, there may be several initiation locations for sequential initializing of the explosive material.

The propelling speed of the disrupting element corresponds to the speed of the RPG and the actual distance of the disrupting element from the wall, whereby a fast RPG requires that the disrupting element by propelled faster or correspondingly increasing the distance of the disrupting element from the wall.

The RPG Disruption System (RDS) is fitted with a self test system to verify the status and perfection of the system.

The system is in the form of modules fitted for attaching to a wall of an enclosure, each module constructed as discussed hereinabove.

According to the present invention there is also provided a method for protecting an enclosure against RPGs, the method comprising the following steps:

a. Fixing one or more RPG Disruption modules (RDS), in close proximity to a wall of the enclosure facing an anticipated RPG threat, each module comprising a casing comprising an anvil accommodating a propelling mechanism for displacing said disrupting element in a plane substantially parallel to said wall; and an activating system for activating said propelling mechanism so as to propel the disrupting element towards an approaching RPG, to thereby neutralize it;

b. Initiating the system c. Detecting an upcoming RPG threat at predetermined proximity to the wall; and d. propelling the disrupting element towards a head portion of the RPG, to thereby prevent its detonator from activating the explosive.

Any of the above mentioned features referred-to in connection with the system and module may be applied in connection with a method utilizing same, respectively.

BRIEF DESCRIPTION OF THE DRAWINGS

In order to understand the invention and to see how it may be carried out in practice, several embodiments will now be described, by way of non-limiting examples only, with reference to the accompanying drawings, in which:

FIGS. 7A to 7C are sectioned isometric vies illustrating variations of propelling mechanisms for use in the system according to the present invention.

DETAILED DESCRIPTION OF THE INVENTION

Figure 1:
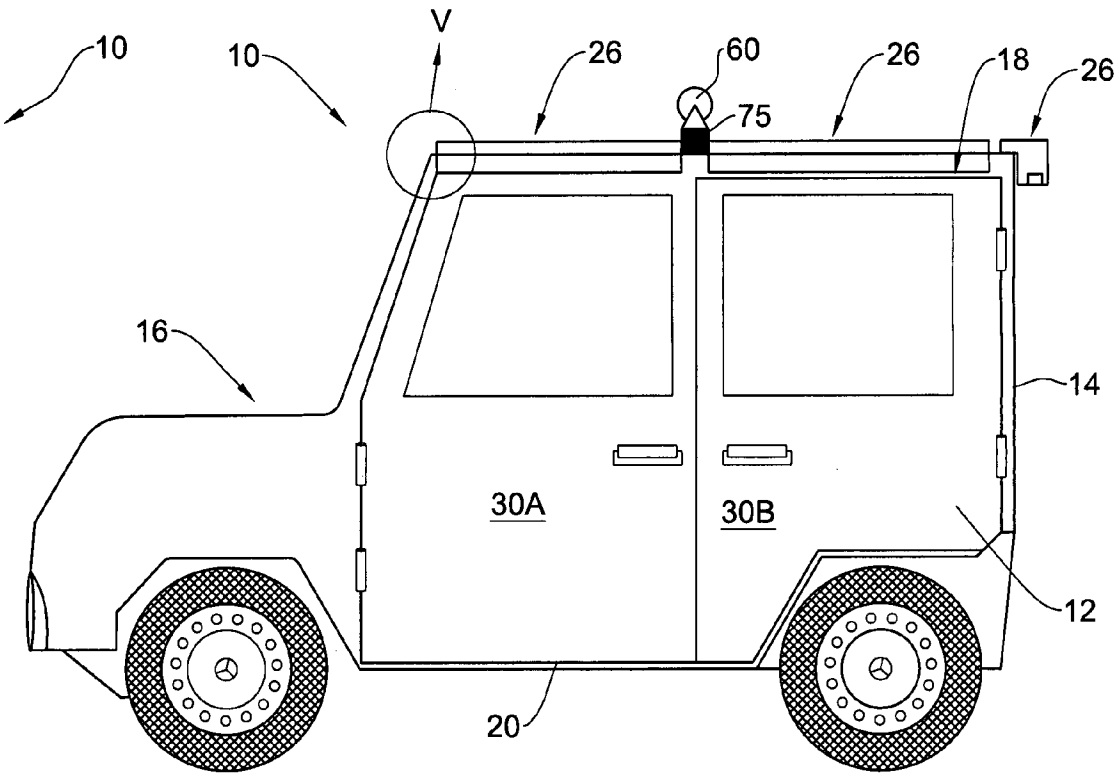
FIG. 1 is a schematic side view of a vehicle fitted with a protective system according to the present invention.
Figure 2:
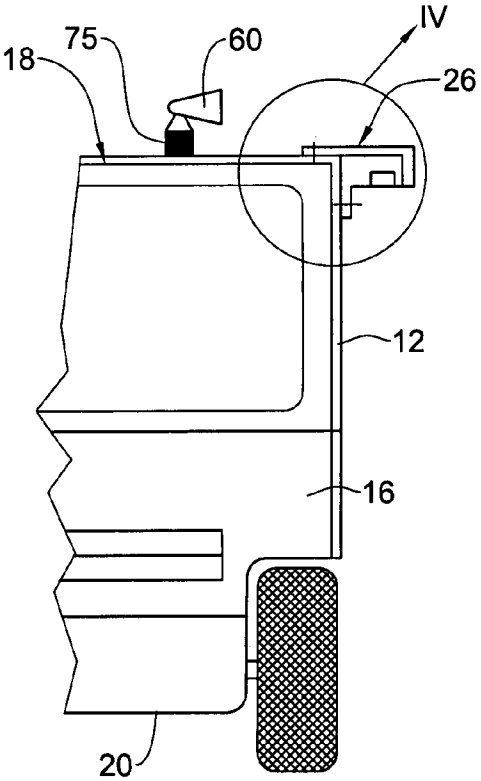
FIG. 2 is schematic side front of the vehicle of FIG. 1.

Attention is first made to FIGS. 1 and 2 of the drawings illustrating an enclosure to be protected against RPG threats, said enclosure being in the particular example a vehicle designated 10. However, an enclosure as referred to in the present invention is referred to in the broad aspect and includes all types of vehicles and structures.

Figure 4A:
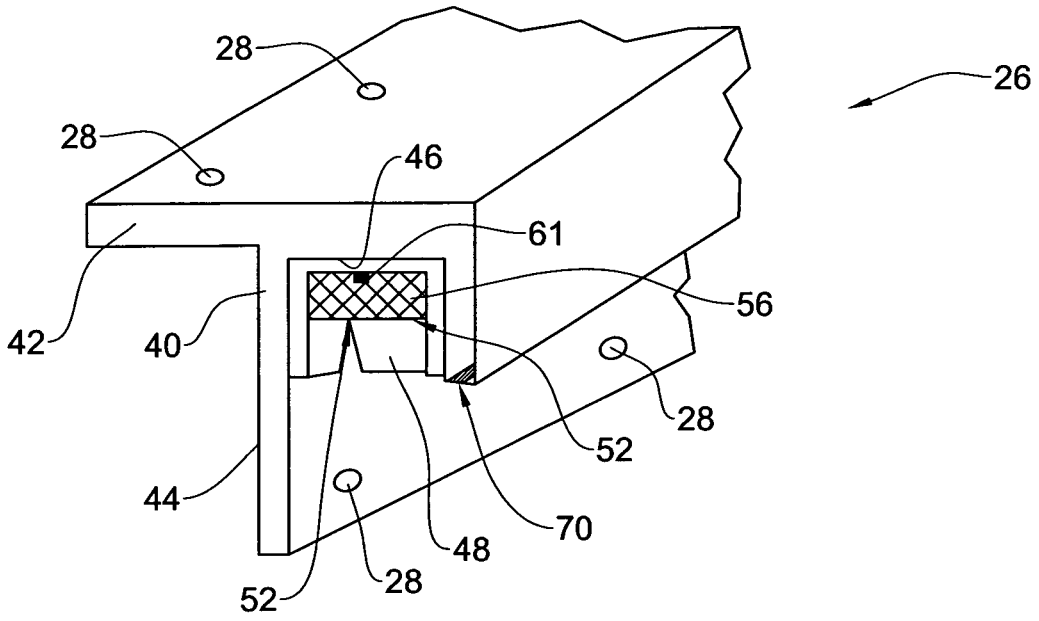
FIG. 4A is an enlargement of the portion marked IV in FIG. 2.
Figure 4B:
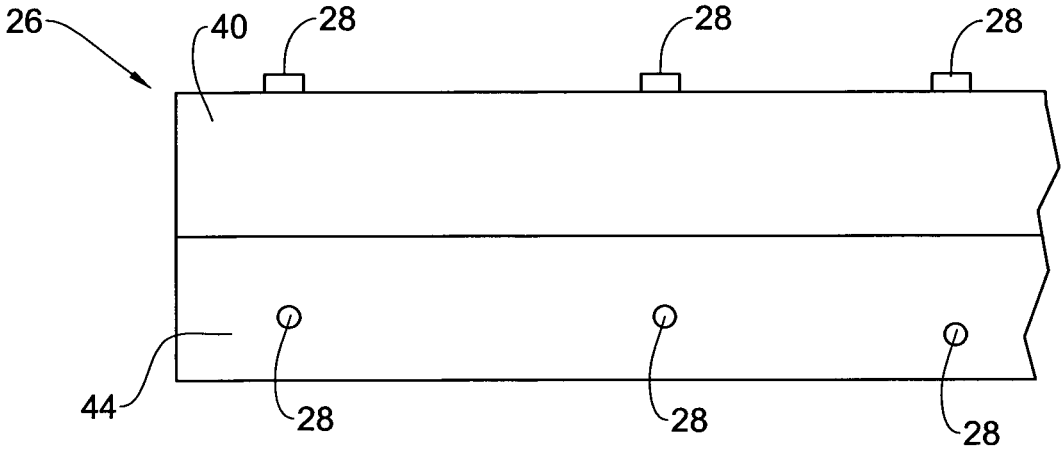
FIG. 4B is an enlargement of the portion marked V in FIG. 1.

The enclosure (vehicle) 10 comprises side walls 12, rear wall 14, front wall 16, a roof 18 and a bottom (chassis) 20. Several RPG Disruption Systems (RDS) according to the invention, generally designated 26, are fitted on the vehicle, the structure of which will become apparent hereinafter. The RDS 26 are detachably fixed to the vehicle; typically to frame elements (structure beams) thereof, by bolts 28 or other fasteners, as illustrated in FIGS. 4A and 4B. Other arrangements are possible to. For example, the RDS may be easily attachable/detachable or even collapsible, whereby the system is rapidly mounted and deployed into an operative state, whilst may be easily removed (or collapsed/folded) so as to facilitate easy maneuvering of a vehicle in tight areas, such as in alleys.

In the particular discussed embodiment the RDS 26 are fixed to the vehicle 10 at its top, above front door 30A passenger door 30B and rear door (not seen), in manner so as not to obstacle the doors or constitute any other disturbance to the operation of the vehicle or comfort of its passengers. As will be discussed hereinafter with reference to FIGS. 6A to 6C, the RDS may be otherwise attached to the enclosure.

The RDS 26 are independent modules, easily mounted and detached for maintenance, replacement, etc.

As can best be seen. in FIGS. 4A and 4B, each RDS module 26 comprises a housing 40 fitted with attachment portions in the form of two flanges 42 and 44, designed for attaching to a wall of an enclosure. Thus, these flanges may assume other configurations depending on the intended enclosure. The RDS modules are parallely attached to the respective walls of the enclosure.

Figure 5A:
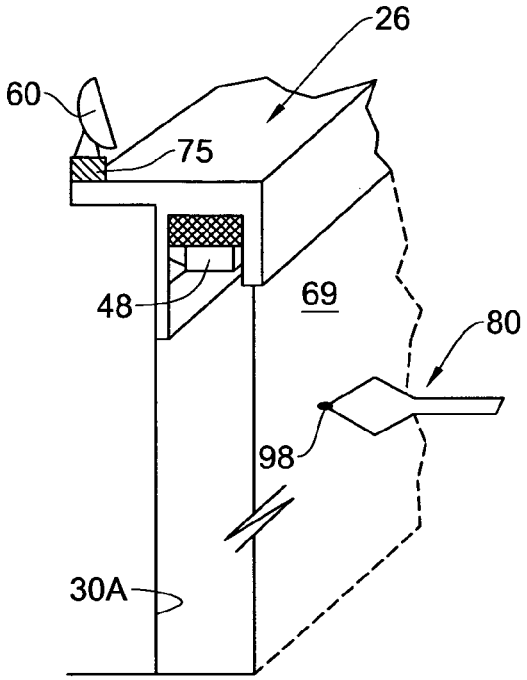
FIGS. 5A to 5D are schematic side views of a vehicle fitted with a protective system according to the present invention, illustrating consecutive steps of neutralizing an approaching RPG.
Figure 5C:
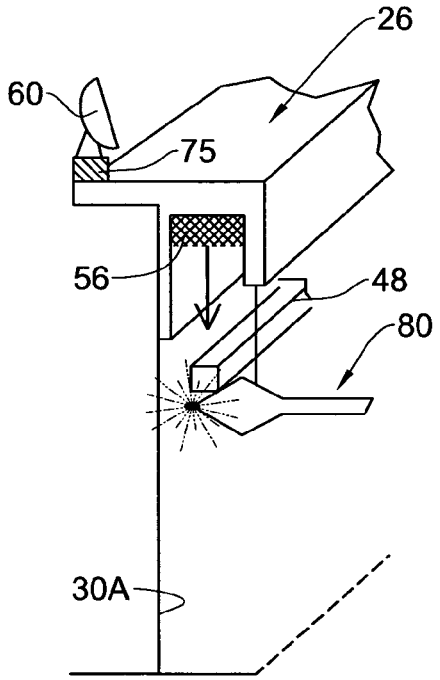
Figure 5B:
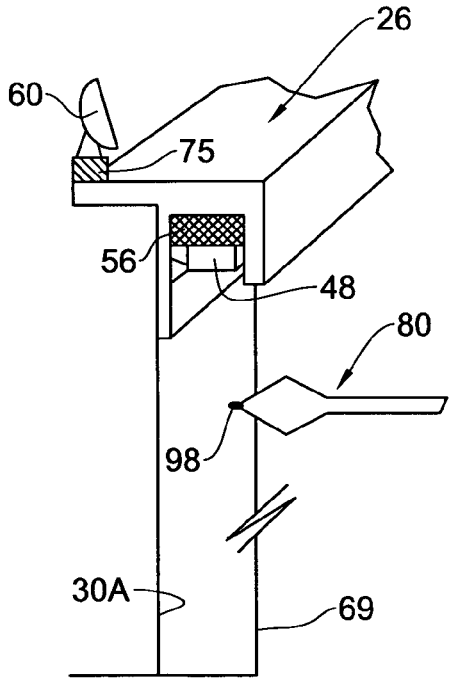
Figure 5D:
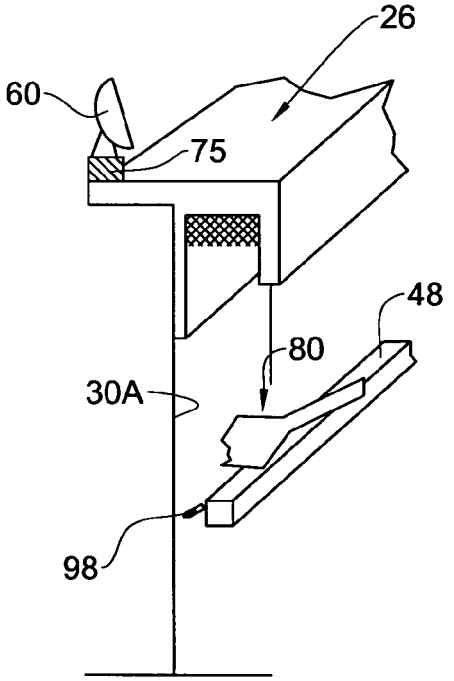

The RDS module 26 is made of rigid material such as metal and is formed with a trough-shaped anvil (e.g. inverted trough-like anvil portion 46) accommodating a disrupting projectile (e.g. downwardly facing disrupting element 48) secured within the anvil 46 by shims 52. Intermediate the anvil 46 and the disrupting element 48 there is a propelling mechanism 56 (e.g. propellant, spring) which in the present example is an amount of explosive material fitted with a detonator 61. It is seen that the disrupting element is secured at a plane substantially parallel to the respective wall, such that upon propelling (FIGS. 5C and 5D) it maintains its parallel position, i.e. remains at a substantially fixed distance from the wall. Likewise, the propelling mechanism is so designed as to propel the disrupting element 48 substantially parallel to the anvil 46. Thus, explosive 56 is homogeneously distributed along the anvil 46. Where a mechanical spring is used, this result is taken care of as well, as will be discussed herein after with reference to FIGS. 7A to 7C.

As shown in FIG. 4A, the trough-like anvil 46 comprises three closed sides and one open side, and the trough-like anvil 46 is oriented so that the open side is perpendicular relative to the wall 12 of the enclosure 10. The propelling mechanism is located adjacent the closed side of the trough-like anvil 46 positioned opposite to the open side of the trough-like anvil 46, and the disrupting element 48 is located adjacent the open side of the trough-like anvil 46. The trough-like anvil 46 opens in a direction parallel to the wall 12 of the enclosure 10. The propelling mechanism 56 is disposed between the anvil 46 and the disrupting element 48. Further, the propelling mechanism 56 is disposed between a closed side of the anvil 46 is located opposite to the open side of the anvil 46 so that the propelling mechanisms propels the disrupting element 48 in the plane substantially parallel to the wall 12 of the enclosure 10. The disrupting element 48 nests within a open side of the trough-like anvil 46.

As can further be noted in FIGS. 1, 2 and 6, the vehicle/enclosure 10 is also fitted with an early detection sensor in the form of radar 60 for initiating the system upon launch of an RPG. Such a sensor may be of known design, for example a thermal detector, flare detector, blast detector, image detector, etc., whereby upon detection of a launched/approaching RPG the system is armed and is ready to handle the threat. Several such sensors may be provided, each facing a different sector, or the sensor may be suited for 360° coverage. Otherwise, the RPG Disruption System (RDS) may be manually initiated (e.g. by a commander of a vehicle) or it may normally set to an initiated, active state. The sensor 60 allows for the system to be maintained at a hibernating state until detection of the launch or approach of an RPG threat. This renders the system safer.

In addition, the system is fitted with a detection system (e.g. detector), for example, defining an imaginary plane (69 in FIG. 5A) covered by the disrupting element 48, for generating an activating signal to instantaneously propel the disrupting element. The detection system in FIGS. 2 and 4A is in the form of an electronic curtain created by detectors 70, namely optic sensor, magnetic sensor, RF sensors and the like. Such sensors may be located at other locations too, e.g. opposite the module 26, etc. The detection system may also be in the form of a mechanical barrier defining said imaginary plane, e.g. a fine mesh (69 in FIGS. 5A-5D), a web or grid, whereupon tension or pressure applied to said material, or piercing same, generates the activating signal. The material may be in the form of a sheet of material embedded with or made of conductive material or coating (e.g. special paints), etc.

A controller (microprocessor) 75 (FIGS. 1 and 2) is provided for coordinating and processing the signals received from the early sensor 60, the imaginary plane penetration detection system and generating a propelling signal to timely propel the disrupting element 48 so as to anticipate the upcoming RPG threat. The controller is also competent for performing periodic or on-demand tests of the system and for minimizing the chance of false alert of the different detectors. Also, the controller is associated with safety parameters of the system, e.g. the system cannot be operated when the doors of a vehicle fitted with same are open, etc.

Figure 3A:
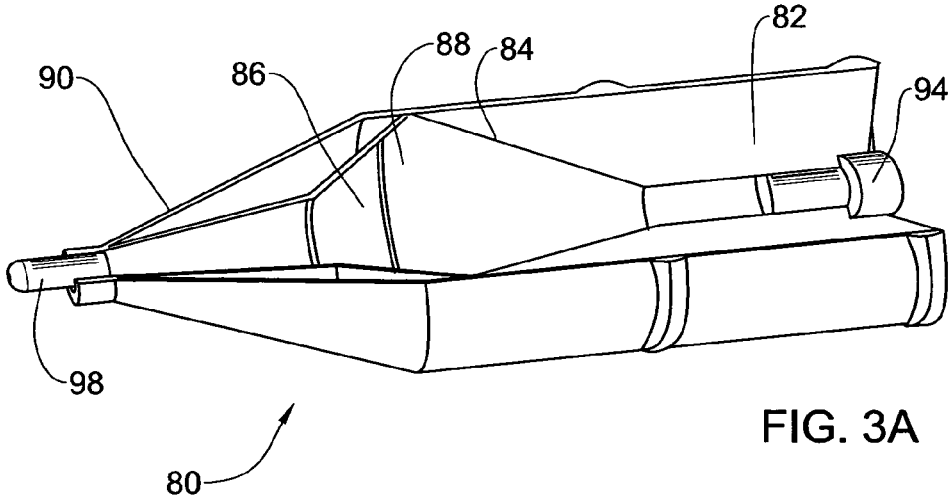
FIG. 3A is an isometric sectioned view of a warhead of an RPG.

An example is provided for understanding the principle of the present invention, further attention is directed to FIG. 3A illustrating a sectioned isometric view of a typical RPG warhead generally designated 80. The warhead is a shaped charge comprising a cylinder of explosive 82 with a metal-lined conical hollow (liner) 84, an inner metal envelope cone 86 which together constitute a hollow space 88, a detonator 94 in conjunction with the explosive 82, said detonator 94 being electrically coupled to a Piezo-electric sensor 98 at a fore end of the warhead via a conductive aerodynamic cover 90 and the inner metal envelope cone 86.

Figure 3B:
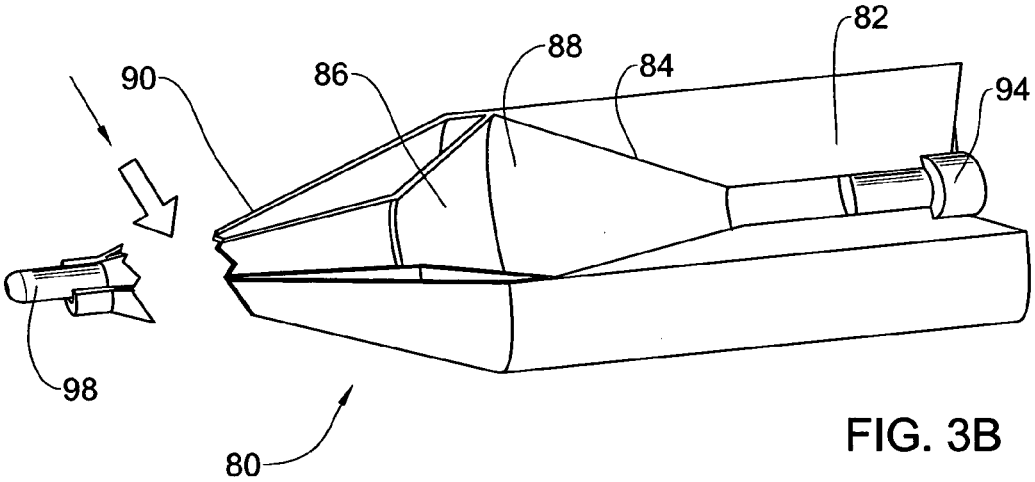
FIGS. 3B and 3C correspond with FIG. 3A and schematically illustrate two fashions of neutralizing the RPG.
Figure 3C:
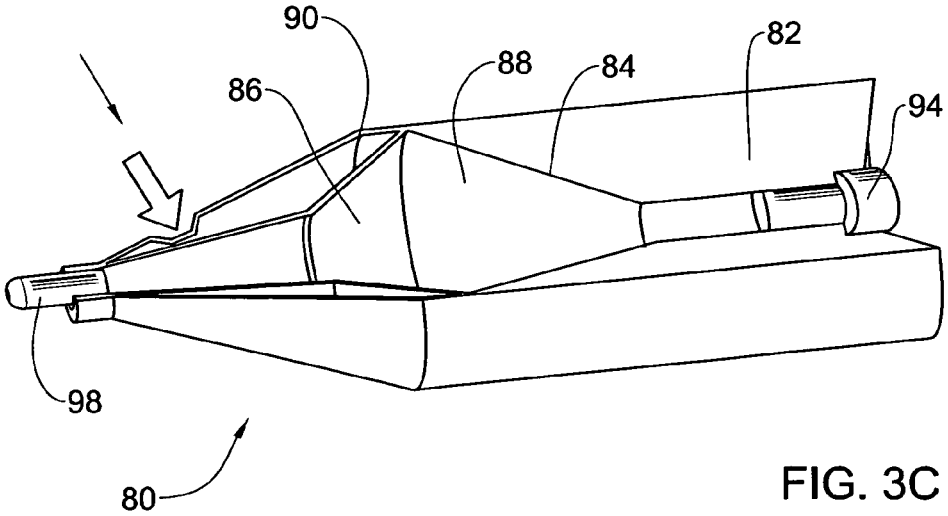

Upon impact of the Piezo-electric sensor 98 with a target, an electric current generates and is conducted via the conductive aerodynamic cover 90 and said inner metal envelope cone 86 and said liner 84 to ignite the detonator 94 resulting in detonation of the explosive 82. Accordingly, disabling/truncating the Piezo-electric sensor 98 (FIG. 3B) or creating an electric shortcut between the aerodynamic cover 90 and the inner metal envelope cone 86 (by their deformation so as to engage with one another; FIG. 3C) will result in failure of the detonator 94 to ignite and the explosive charge 82 from exploding. It should be noted that in some case rather than liner and envelope conducting element, electric conductivity is by means of wiring.

In operation, when an enclosure (a vehicle in the present example) is fitted with an RDS system according to the present invention, the system (controller 75) is set to an 'on' position and upon entry of the vehicle 10 into a hostile arena the early detection sensor 60 is activated. Detection of a launch of an RPG or its approach will arm the system (FIG. 5A), anticipating the nearing RPG threat. At the instance of penetration of the fore end of the warhead 80 of the RPG (i.e. the Piezo-electric sensor 98) into the imaginary plane 69 (FIG. 5B), the detectors 70 generate a signal to the controller 75 which in turn generates a propelling signal to instantly propel the disrupting element 48 by igniting the explosive material 56 (FIG. 5C) to strike against the warhead 80, resulting in disabling/truncating the Piezo-electric sensor 98 or creating an electric shortcut between the aerodynamic cover 90 and the inner metal envelope cone 86 (FIG. 5D), resulting in failure of the detonator 94 to ignite and the explosive charge 82 from exploding.

RPGs in the arena typically fly at substantially low speeds, thus propelling the disrupting element 48 at substantially high speed, whereby a module according to the present invention may be fitted adjacent (in close proximity) to the wall of the enclosure to be protected, whereby the overall dimensions of the enclosure are less affected.

Furthermore, by propelling the disrupting element 48 at a substantially high speed, the RPG threat becomes neutralized by preventing initiation of the explosive material (as opposed to deflecting or breaking the threat). This takes place, as explained herein above, by disrupting the electric initializing of the explosive either by breaking or truncating the Piezo-electric sensor from the RPG or by causing an electric shortcut by deforming the aerodynamic cover 90 and the inner metal envelope cone 86. Accordingly, there is no need for high momentum of the disrupting element.

Figure 6A:
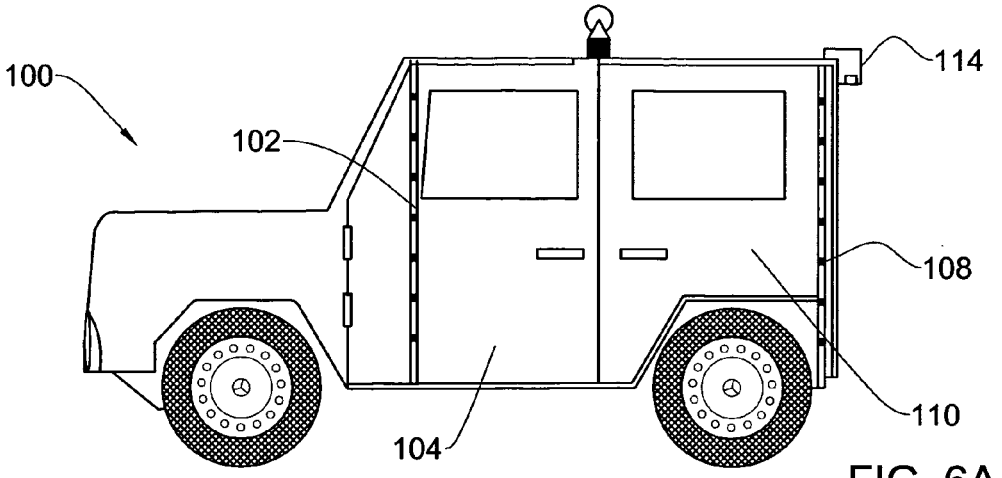
FIGS. 6A to 6C schematically illustrate variations of applying a protective system according to the present invention over a wall of an enclosure, a vehicle in the particular drawings.
Figure 6B:
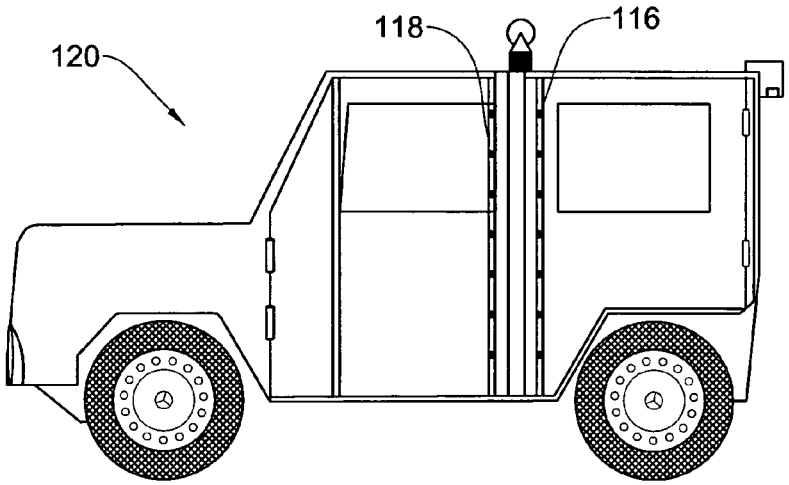
Figure 6C:
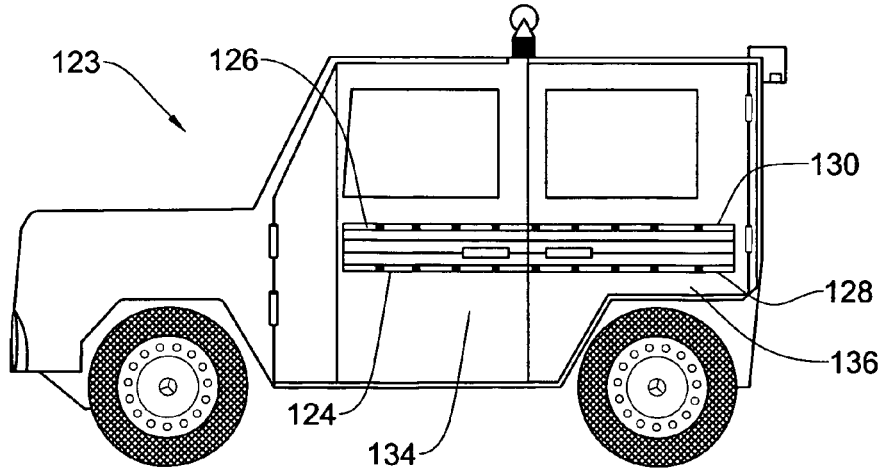

Turning now to FIGS. 6A to 6C there are illustrated exemplary configurations of fitting a vehicle with RDS according to the present invention. In FIG. 6A the vehicle 100 is fitted with a front RDS module 102 fitted at a front edge of the front door 104 and another RDS 108 fitted at a rear end of the vehicle, behind the rear door 110, whereby the RDS 102 and 108 are substantially vertical and face one another with a rear of the vehicle protected by a horizontally extending RDS 114 at a top end thereof. In the example of FIG. 6B the RDS 116 and 118 extend vertically at a center of the vehicle 120, in a back-to-back orientation, such that rear RDS 116 covers the rear door portion and the front RDS 118 covers the front of the vehicle, respectively. FIG. 6C illustrates an alternative embodiment for protecting a vehicle 123, comprising a front bottom RDS 124, a front top RDS 126, a rear bottom RDS 128 and a rear top RDS 130, respectively mounted on the front door 134 and the rear door 136.

Figure 7A:
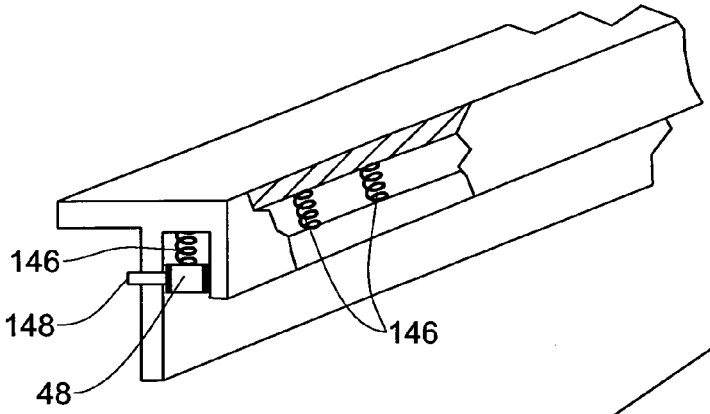
FIGS. 7A to 7C are schematic illustrations of alternate propelling mechanisms.
Figure 7B:
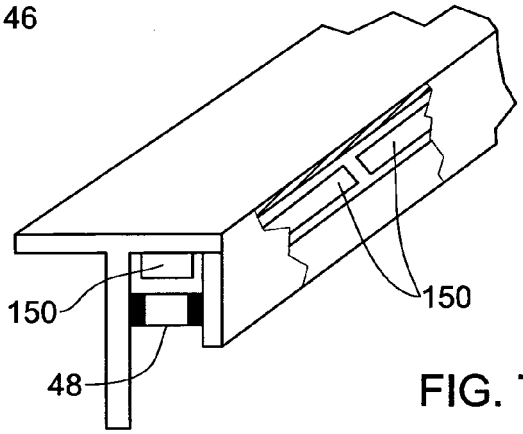
Figure 7C:
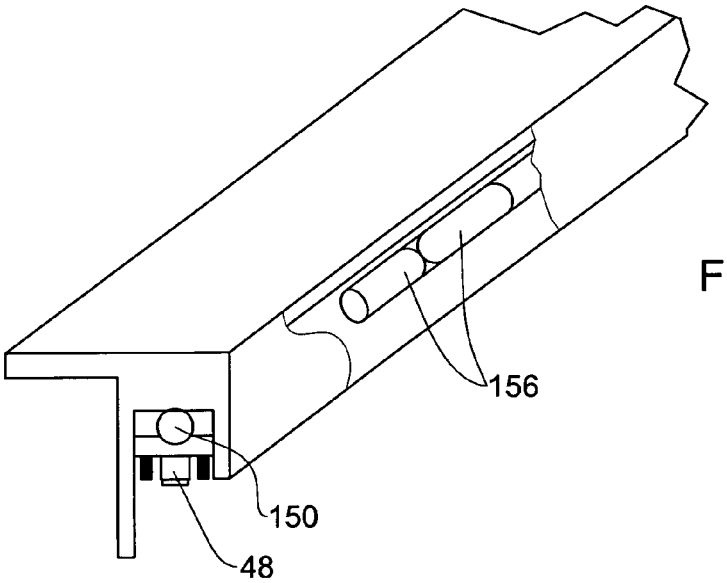
Figures 8A, 8B, 8C, 8D, 8E, 8F:
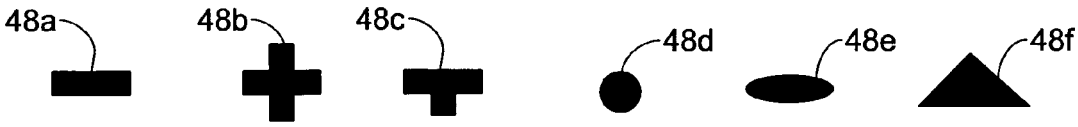
FIGS. 8A to 8F are exemplary cross sections of disrupting elements useful in a system according to the present invention.

FIGS. 7A to 7C illustrate alternative modifications of propelling mechanisms for propelling of the disrupting element 48. In FIG. 7A the explosive charge is replaced by an array of compression springs 146 maintained at their normally compressed state, whereby upon retraction of several retention pins 148 (e.g. by a solenoid) the springs 146 expand so as to propel the disrupting element 48. In FIG. 7B the propelling mechanism is in the form of a 'magnetic spring' composed of one or more magnets 150 with their polarity opposite that of the disrupting element 48. The magnets may be permanent magnets (in which case the disrupting element is retained by a mechanical arresting arrangement as discussed hereinbefore), or charged per demand, i.e. an array of coils is provided (not shown) for generating a powerful magnetic field with directional orientation so as to propel the disrupting element. In FIG. 7C the propelling mechanism is in the form of a pneumatic spring comprising one or more compressed gas cylinders 156, with the disrupting element 48 retained within the anvil portion 46 of the housing 40 by retention pins (not seen), whereby rapid discharge of the high-pressurized gas entails rapid propelling of the disrupting element, with tear/break of the retention pins.

Turning now to FIGS. 8A to 8F there are illustrated exemplary cross sections of disrupting elements designated 48*a* to 48*f*, respectively, useful in a system according to the present invention, these being examples only.

Those skilled in the art to which this invention pertains will readily appreciate that numerous changes, variations, and modifications can be made without departing from the scope of the invention, mutatis mutandis.

The invention claimed is:

1. A rocket propelled grenade (RPG) disruption system for protecting a wall of an enclosure against RPG's, the wall having an upper periphery and a lower periphery, the system comprising:

a casing having a trough shaped portion, the trough shaped portion of the casing having a first side wall directly fixed along at least a portion of the upper periphery of the wall to be protected, and a second side wall comprising a detector for detecting the RPG, the detector configured so that upon penetration of a fore end of the RPG's head portion approaching the wall into a plane of the detector, the detector generates an activating signal;

a trough-shaped anvil accommodated within the trough-shaped portion of the casing and a bar-shaped disrupting projectile accommodated within the anvil, the anvil being configured to locate the disrupting projectile adjacent to the wall to be protected, the anvil being oriented relative to the wall to be protected so that the disrupting projectile faces in a direction parallel to the wall to be protected;

a propellant accommodated within the anvil, the propellant and anvil configured for propelling the disrupting projectile downwardly toward a ground plane in a direction parallel to the wall to be protected;

a controller for receiving the activating signal from the detector and then generating a control signal to activate the propellant and timely propel the disrupting projectile into the head portion of the RPG, thereby preventing a detonator of the RPG from initiating an explosive within the RPG and neutralizing the RPG.

2. The RPG disruption system according to claim 1, wherein the system is configured so that the RPG is neutralized by disrupting electric activation of the detonator by truncating a Piezo-electric sensor at the fore end of the RPG, or by causing an electric shortcut by deforming a conductive front aerodynamic cover and an inner metal envelope cone, or by shortcutting or detaching electric wiring associated with the detonator.

3. The RPG disruption system according to claim 1, further comprising an early detection sensor configured for detecting the RPG launched and initiating one or more systems, facing the RPG approaching the wall of the enclosure.

4. The RPG disruption system according to claim 1, wherein the propellant and anvil are designed for propelling the disrupting projectile by applying a bursting force between the anvil and the disrupting projectile, and whereby the disrupting projectile is propelled parallel to the anvil.

5. The RPG disruption system according to claim 1, wherein a disruption module comprises a casing, the anvil, the disrupting projectile, and propellant, the system comprising multiple disruption modules.

6. The RPG disruption system according to claim 1, wherein the anvil is configured to propel the disrupting projectile in a plane parallel to the wall of the enclosure.

7. The RPG disruption system according to claim 6, wherein the anvil is oriented to propel the disrupting projectile in the plane parallel to the wall of the enclosure.

8. The RPG disruption system according to claim 1, wherein the anvil is oriented to propel the disrupting projectile in a plane parallel to the wall of the enclosure.

9. The RPG disruption system according to claim 1, wherein the anvil comprises three closed sides and one open side, the anvil being oriented so that the open side faces in a direction parallel to the wall of the enclosure.

10. The RPG disruption system according to claim 9, the propellant is located adjacent to the closed side positioned opposite to the open side of the anvil, and the disrupting projectile is located adjacent to the open side of the anvil.

11. The RPG disruption system according to claim 1, wherein the anvil opens in a direction parallel to the wall of the enclosure.

12. The RPG disruption system according to claim 1, wherein the propellant is disposed between a closed side of the anvil and the disrupting projectile, the closed side of the anvil being located opposite to the open side of the anvil so that the propellant propels the disrupting projectile in a plane parallel to the wall of the enclosure.

13. The RPG disruption system according to claim 1, further comprising a housing, the housing comprising at least one wall in common with the side wall of the anvil.

14. The RPG disruption system according to claim 13, wherein the housing comprises walls defining walls of the anvil.

15. The RPG disrupting system according to claim 1, wherein the anvil is an inverted anvil accommodating a downwardly facing disrupting projectile.

16. The RPG disrupting system according to claim 15, wherein the inverted anvil is fixed above a portion of the wall to be protected.

17. The RPG disrupting system according to claim 16, wherein the anvil is fixed along an upper end of the wall to be protected.

18. The RPG disrupting system according to claim 1, further comprising a housing defining the anvil, the housing comprising a first attachment portion and a second attachment portion, the first attachment portion being angled relative to the second attachment portion.

19. The RPG disrupting system according to claim 18, wherein the first attachment portion is oriented perpendicular relative to the second attachment portion.

20. The RPG disrupting system according to claim 18, wherein the first attachment portion is oriented perpendicular relative to the wall to be protected, and the second attachment portion is orient parallel relative to the wall to be protected.

21. The RPG disrupting system according to claim 20, wherein the first attachment portion defines a bottom wall of the anvil, and the second and third attachment portions define side walls of the anvil.

22. The RPG disrupting system according to claim 20, wherein the housing comprises a third attachment portion, and the first, second, and third attachment portions define the anvil.

23. The RPG disrupting system according to claim 22, wherein the housing is connected to a top wall of the enclosure and the wall to be protected of the enclosure.

24. The RPG disrupting system according to claim 1, wherein the propellant is an explosive material homogeneously distributed along the anvil, the explosive material being fitted with a detonator.

25. A rocket propelled grenade (RPG) disruption system for protecting a wall of an enclosure against RPG's, the wall having an upper periphery and a lower periphery, the system comprising:

a casing having a trough shaped portion, the trough shaped portion of the casing having a first side wall directly fixed along at least a portion of the upper periphery of the wall to be protected, and a second side wall comprising a detector for detecting the RPG, the detector configured so that upon penetration of a fore end of the RPG's head portion approaching the wall into a plane of the detector, the detector generates an activating signal;

a trough-shaped anvil accommodated within the trough-shaped portion of the casing and a bar-shaped disrupting projectile accommodated within the anvil, the anvil being configured to locate the disrupting projectile adjacent to the wall to be protected, the anvil being oriented relative to the wall to be protected so that the disrupting projectile faces in a direction parallel to the wall to be protected;

a spring accommodated within the anvil, the spring and anvil configured for propelling the disrupting projectile downwardly toward a ground plane in a direction parallel to the wall to be protected;

a controller for receiving the activating signal from the detector and then generating a control signal to activate the propellant and timely propel the disrupting projectile into the head portion of the RPG, thereby preventing a detonator of the RPG from initiating an explosive within the RPG and neutralizing the RPG.

26. A method for protecting an enclosure against an RPG, the method comprising:

fixing one or more disruption modules to a wall of the enclosure having an upper periphery and a lower periphery, each module comprising:

a casing having a trough shaped portion, the trough shaped portion of the casing having a first side wall directly fixed along at least a portion of the upper periphery of the wall of the enclosure, and a second side wall comprising a detector for detecting the RPG and generating an activating signal, the detector configured so that upon penetration of a fore end of the RPG's head portion approaching the wall into a plane of the detector, the detector generates an activating signal, a trough-shaped anvil accommodated within the trough-shaped portion of the casing, the trough shaped anvil containing a bar-shaped disrupting projectile and a propellant, the anvil and the propellant being configured for propelling the disrupting projectile adjacent to the wall to be protected, the anvil being oriented relative to the wall to be protected so that the disrupting projectile faces in a direction parallel to the wall to be protected, and a controller for receiving the activating signal from the detector and then generating a control signal to activate the propellant;

initiating the system;

detecting penetration of the fore end of the RPG's head portion approaching the wall into the plane of the detector and generating the control signal to activate the propellant; and projectile downwardly toward a ground plane and the disrupting projectile in a plane parallel to the wall towards the head portion of the RPG, to thereby prevent the detonator of the RPG from initiating explosive within the RPG and neutralizing the RPG.

* * * * *